US011542950B2

(12) United States Patent
Miwata et al.

(10) Patent No.: US 11,542,950 B2
(45) Date of Patent: Jan. 3, 2023

(54) VACUUM PUMP

(71) Applicant: Edwards Japan Limited, Chiba (JP)

(72) Inventors: Tooru Miwata, Chiba (JP); Yoshiyuki Takai, Chiba (JP); Yoshiyuki Sakaguchi, Chiba (JP)

(73) Assignee: Edwards Japan Limited, Chiba (JP)

( * ) Notice: Subject to any disclaimer, the term of this patent is extended or adjusted under 35 U.S.C. 154(b) by 122 days.

(21) Appl. No.: 17/040,799

(22) PCT Filed: Mar. 20, 2019

(86) PCT No.: PCT/JP2019/011930
§ 371 (c)(1),
(2) Date: Sep. 23, 2020

(87) PCT Pub. No.: WO2019/188732
PCT Pub. Date: Oct. 3, 2019

(65) Prior Publication Data

US 2021/0010479 A1 Jan. 14, 2021

(30) Foreign Application Priority Data

Mar. 30, 2018 (JP) ..... JP2018-069353

(51) Int. Cl.
*F04D 19/04* (2006.01)
*F04D 29/048* (2006.01)
*F04D 29/58* (2006.01)

(52) U.S. Cl.
CPC ..... *F04D 19/042* (2013.01); *F04D 29/048* (2013.01); *F04D 29/584* (2013.01);
(Continued)

(58) Field of Classification Search
CPC .... F04D 19/042; F04D 19/044; F04D 29/584; F04D 29/048; F04D 29/5853
See application file for complete search history.

(56) References Cited

U.S. PATENT DOCUMENTS

2002/0039533 A1* 4/2002 Miyamoto ..... F04D 29/584 417/313
2003/0175131 A1* 9/2003 Ishikawa ..... F04D 29/584 417/423.4

(Continued)

FOREIGN PATENT DOCUMENTS

JP H10205486 A 8/1998
JP 2002180988 A 6/2002

(Continued)

OTHER PUBLICATIONS

European Communication dated Nov. 22, 2021 and Supplementary European Search Report dated Nov. 11, 2021 for corresponding European application Serial No. EP 19777402, 8 pages.

(Continued)

*Primary Examiner* — Kenneth J Hansen
(74) *Attorney, Agent, or Firm* — Theodore M. Magee; Westman, Champlin & Koehler, P.A.

(57) ABSTRACT

A vacuum pump capable of suppressing the solidification of gas in a normal operation of a pump is provided. Provided is a vacuum pump including a casing that has an inlet port for sucking gas from outside and an outlet port for exhausting the gas to the outside; a turbo-molecular-pump mechanism that is disposed in the casing and includes rotor blades and stator blades alternately arranged in multiple stages in an axial direction; a thread-groove-pump mechanism that is disposed in the casing and is connectedly disposed on an exhaust side of the turbo-molecular-pump mechanism; first temperature regulating means that is configured to regulate cooling of the turbo-molecular-pump mechanism; and second temperature regulating means that is configured to regulate heating of the thread-groove-pump mechanism.

11 Claims, 5 Drawing Sheets

(52) U.S. Cl.
CPC ..... *F04D 29/5853* (2013.01); *F05B 2240/51* (2013.01); *F05B 2260/231* (2013.01); *F05B 2280/1021* (2013.01); *F05B 2280/5004* (2013.01)

(56) References Cited

U.S. PATENT DOCUMENTS

| | | | | |
|---|---|---|---|---|
| 2015/0086328 | A1* | 3/2015 | Tsutsui | F04D 27/02 415/47 |
| 2015/0219116 | A1* | 8/2015 | Tsutsui | F04D 29/584 415/175 |
| 2016/0160877 | A1 | 6/2016 | Sakaguchi | |

FOREIGN PATENT DOCUMENTS

| | | | |
|---|---|---|---|
| JP | 2003148379 | A | 5/2003 |
| JP | 3616639 | B2 | 2/2005 |
| JP | 2011163127 | A | 8/2011 |
| JP | 2015148162 | A | 8/2015 |

OTHER PUBLICATIONS

PCT International Search Report dated Jun. 25, 2019 for corresponding PCT Application No. PCT/JP2019/011930.
PCT International Written Opinion dated Jun. 25, 2019 for corresponding PCT Application No. PCT/JP2019/011930.

* cited by examiner

VACUUM PUMP

CROSS-REFERENCE OF RELATED APPLICATION

This application is a Section 371 National Stage Application of International Application No. PCT/JP2019/011930, filed Mar. 20, 2019, which is incorporated by reference in its entirety and published as WO 2019/188732 A1 on Oct. 3, 2019 and which claims priority of Japanese Application No. 2018-069353, filed Mar. 30, 2018.

BACKGROUND

The present invention relates to a vacuum pump and in particular to a vacuum pump used for a semiconductor manufacturing apparatus and an analyzer or the like.

During the manufacturing of a semiconductor device including memory and an integrated circuit, in order to avoid the influence of dust or the like in the air, an insulating film, a metal film, and a semiconductor film are formed and etched in a high-vacuum process chamber. In the process, gas introduced into the process chamber is exhausted to have a predetermined high degree of vacuum in the process chamber by using, for example, vacuum pumps such as a combination pump including a turbo molecular pump and a thread groove pump.

A vacuum pump that is a combination of a turbo molecular pump and a thread groove pump includes: an exhaust function unit that has rotor blades and stator blades alternately placed in multiple stages in the axial direction; thread groove means connected to the exhaust side of the exhaust function unit; and spacers for fixing spacings between the stator blades, in a casing having an inlet port for sucking a reaction product (gas) generated in a process chamber and an outlet port for exhausting the sucked reaction product to the outside.

The exhaust function unit stored in the casing is configured such that the stator blades are attached to a stator and the rotor blades of the respective stages are attached to a rotor while being disposed between the stator blades opposed to the rotor blades. The rotor is rotated with the rotor blades, forming a gas transfer unit where gas is transferred between the rotor blades and the stator blades. The rotor is rotated at a constant speed by driving means, e.g., an electric motor and the reaction product in the gas transfer unit is transferred to the exhaust side, so that external gas is sucked.

The reaction product is typically chlorine-type gas or fluorine sulfide-type gas. The gas has a low degree of vacuum and rises in sublimation temperature with a pressure, so that the gas is likely to be solidified and deposited in the vacuum pump. When the reaction product is deposited in the vacuum pump, a passage for the reaction product may be narrowed so as to reduce the capability of compression and exhaust by the vacuum pump. If the gas transfer unit in which the rotor blades and the stator blades are made of materials such as aluminum and a stainless material reaches an extremely high temperature, the rotor blades and the stator blades may decrease in strength and rupture during an operation. Moreover, electric parts in the vacuum pump and an electric motor for rotating the rotor may not offer desired performance at high temperatures. Thus, the vacuum pump needs temperature control for keeping a predetermined temperature.

As a vacuum pump for suppressing the deposition of a reaction product, the following structure is known: a cooling apparatus or a heating apparatus is provided around a stator so as to control a temperature in a gas passage and gas in the gas passage can be transferred without being solidified (for example, see Japanese Patent Application Publication No. H10-205486).

The discussion above is merely provided for general background information and is not intended to be used as an aid in determining the scope of the claimed subject matter. The claimed subject matter is not limited to implementations that solve any or all disadvantages noted in the background.

SUMMARY

As described above, gas sucked into the vacuum pump rises in sublimation temperature with a degree of vacuum and a pressure, so that the gas is likely to be solidified and deposited in the vacuum pump. Unfortunately, the gas transfer unit including the rotor blades and the stator blades may decrease in strength at an extremely high temperature or the performance of the electric parts in the vacuum pump and the electric motor may be adversely affected. Thus, it is preferable to control a temperature so as to suppress the solidification of gas in the normally operated vacuum pump without adversely affecting the performance of electric parts and the electric motor in the vacuum pump or reducing the strength of the gas transfer unit.

In the vacuum pump described in Japanese Patent Application Publication No. H10-205486, however, a temperature is controlled but sufficiently satisfactory temperature control measures are not taken. Thus, the vacuum pump is in need of improvements.

This causes technical problems to be solved to further suppress the solidification of gas in a normal operation of a pump. An object of the present invention is to solve the problems.

The present invention is proposed to attain the object. The invention as in claim 1 provides a vacuum pump, including: a casing, the casing having an inlet port for sucking gas from outside and an outlet port for exhausting the gas to the outside; a turbo-molecular-pump mechanism, the turbo-molecular-pump mechanism being disposed in the casing and including rotor blades and stator blades alternately arranged in multiple stages in an axial direction; a thread-groove-pump mechanism, the thread-groove-pump mechanism being disposed in the casing and being connectedly disposed on an exhaust side of the turbo-molecular-pump mechanism; a bearing, the bearing rotatably holding a rotating portion of the turbo-molecular-pump mechanism and a rotating portion of the thread-groove-pump mechanism; and a motor portion configured to rotate the rotating portions, the vacuum pump further including: first temperature regulating means configured to regulate cooling of the turbo-molecular-pump mechanism; and second temperature regulating means configured to regulate heating of the thread-groove-pump mechanism.

With this configuration, the cooling of the turbo-molecular-pump mechanism is regulated by the first temperature regulating means and the heating of the thread-groove-pump mechanism is regulated by the second temperature regulating means, so that the temperature of the turbo-molecular-pump mechanism and the temperature of the thread-groove-pump mechanism can be separately controlled. Thus, the temperature of gas passing through the gas transfer units can be minutely controlled in each portion of the casing. In other words, the temperature can be minutely controlled without adversely affecting electric parts in the vacuum pump and an electric motor for rotating a rotor and without affecting a decrease in the strength of the rotor and a stator. This achieves a normal operation of the pump while efficiently suppressing the solidification of gas.

The invention as in claim 2 provides, in the configuration according to claim 1, a vacuum pump including heat insulating means, the heat insulating means being provided between the stator of the turbo-molecular-pump mechanism and the stator of the thread-groove-pump mechanism and between the stator of the thread-groove-pump mechanism and the stator of the motor portion.

With this configuration, the heat insulating means is provided between the stator of the turbo-molecular-pump mechanism and the stator of the thread-groove-pump mechanism and between the stator of the thread-groove-pump mechanism and the stator of the motor portion. Thus, the temperature of the turbo-molecular-pump mechanism and the temperature of the thread-groove-pump mechanism can be separately controlled without affecting the motor portion.

The invention as in claim 3 provides, in the configuration according to claim 1 or 2, a vacuum pump in which the bearing and the stator of the motor portion are always cooled.

With this configuration, the bearing and the motor portion are always cooled. Thus, the temperature of the turbo-molecular-pump mechanism and the temperature of the thread-groove-pump mechanism can be separately controlled without affecting the bearing and the motor portion.

The invention as in claim 4 is, in the configuration according to claim 1, 2, or 3, a vacuum pump according to claim 1, 2, or 3, in which a stator of the turbo-molecular-pump mechanism includes a temperature sensor and a cooling structure, a stator of the thread-groove-pump mechanism includes a temperature sensor and a heating structure, the first temperature regulating means regulates the temperature of the cooling structure of the turbo-molecular-pump mechanism based on a temperature detected by the temperature sensor of the turbo-molecular-pump mechanism, and the second temperature regulating means regulates the temperature of the heating structure of the thread-groove-pump mechanism based on a temperature detected by the temperature sensor of the thread-groove-pump mechanism.

With this configuration, the temperature of the stator of the turbo-molecular-pump mechanism is regulated by controlling the cooling structure of the turbo-molecular-pump mechanism by means of the first temperature regulating means based on a temperature detected by the first temperature sensor of the turbo-molecular-pump mechanism. The temperature of the stator of the thread-groove-pump mechanism is regulated by controlling the heating structure of the thread-groove-pump mechanism by means of the second temperature regulating means based on a temperature detected by the second temperature sensor of the thread-groove-pump mechanism. In other words, the temperature of the turbo-molecular-pump mechanism and the temperature of the thread-groove-pump mechanism can be separately controlled.

The invention as in claim 5 provides, in the configuration according to claim 1, 2, 3, or 4, a vacuum pump in which the turbo-molecular-pump mechanism is divided into an upper-stage-group gas transfer unit that includes the rotor blades and the stator blades arranged in multiple stages near the inlet port and is cooled by the first temperature regulating means, and a lower-stage-group gas transfer unit that is disposed near the thread-groove-pump mechanism and is heated by the second temperature regulating means, and the temperature of the lower-stage-group gas transfer unit is regulated by the second temperature regulating means via the thread-groove-pump mechanism.

With this configuration, the second temperature regulating means can collectively control the temperature of the lower-stage-group gas transfer unit of the turbo-molecular-pump mechanism and the temperature of the thread-groove-pump mechanism.

The invention as in claim 6 provides, in the invention according to claim 5, a vacuum pump including heat insulating means between the upper-stage-group gas transfer unit and the lower-stage-group gas transfer unit.

With this configuration, the heat insulating means is provided between the upper-stage-group gas transfer unit and the lower-stage-group gas transfer unit so as to block thermal interference between the gas transfer units. Hence, the temperature of the upper-stage-group gas transfer unit and the temperature of the lower-stage-group gas transfer unit can be separately controlled. Thus, the temperature of gas passing through the gas transfer units can be minutely controlled in each of the gas transfer units. In other words, the temperature can be minutely controlled without adversely affecting electric parts in the vacuum pump and an electric motor for rotating a rotor and without affecting a decrease in the strength of the rotor and a stator. This achieves a normal operation of the pump while efficiently suppressing the solidification of gas.

The invention as in claim 7 provides, in the configuration according to claim 5 or 6, a vacuum pump in which the heat insulating means is in close contact with the lower-stage-group gas transfer unit and is disposed with a clearance created between the heat insulating means and the upper-stage-group gas transfer unit.

With this configuration, a predetermined clearance for heat insulation is provided between the heat insulating means and the lower-stage-group gas transfer unit. This enhances the heat insulation effect of the heat insulating means between the upper-stage-group gas transfer unit and the lower-stage-group gas transfer unit and facilitates the control of a proper temperature necessary for the upper-stage-group gas transfer unit and the control of a proper temperature necessary for the lower-stage-group gas transfer unit.

The invention as in claim 8 provides, in the configuration according to claim 5, 6, or 7, a vacuum pump in which the turbo-molecular-pump mechanism includes a clearance of a predetermined amount for heat insulation between the upper-stage-group gas transfer unit and the lower-stage-group gas transfer unit that are axially separated from each other.

With this configuration, a clearance of a predetermined amount for heat insulation is axially created between the upper-stage-group gas transfer unit and the lower-stage-group gas transfer unit. This enhances the heat insulation effect between the upper-stage-group gas transfer unit and the lower-stage-group gas transfer unit and facilitates the control of a proper temperature necessary for the upper-stage-group gas transfer unit and the control of a proper temperature necessary for the lower-stage-group gas transfer unit.

The invention as in claim 9 provides, in the configuration according to claim 5, 6, 7, or 8, a vacuum pump in which the heat insulating means is a stainless material.

With this configuration, a material having low heat conductivity, that is, a material hardly conducting heat, for example, an aluminum material is used for heat insulation between the upper-stage-group gas transfer unit and the lower-stage-group gas transfer unit, thereby easily obtaining a desired effect of heat insulation.

The invention as in claim 10 provides, in the configuration according to claim 5, 6, 7, 8, or 9, a vacuum pump in which the first temperature regulating means regulates the temperature of the upper-stage-group gas transfer unit based on a temperature detected by the first temperature sensor for detecting the temperature of the upper-stage-group gas transfer unit, and the second temperature regulating means regulates the temperature of the thread-groove-pump mechanism based on a temperature detected by the second temperature sensor for detecting the temperature of the thread-groove-pump mechanism.

With this configuration, the temperature of the upper-stage-group gas transfer unit is regulated based on a temperature detected by the first temperature sensor for detecting the temperature of the upper-stage-group gas transfer unit, and the temperature of the lower-stage-group gas transfer unit is regulated via the thread-groove-pump mechanism based on a temperature detected by the second temperature sensor for detecting the temperature of the thread-groove-pump mechanism. This facilitates proper temperature regulation on the turbo-molecular-pump mechanism and proper temperature regulation on the thread-groove-pump mechanism.

The invention as in claim 11 provides, in the configuration according to claim 1, 2, 3, 4, 5, 6, 7, 8, 9, or 10, a vacuum pump in which the bearing and the bearing portion of the motor portion are magnetic bearings.

With this configuration, in the vacuum motor where the bearing and the bearing portion of the motor portion are magnetic bearings, the temperature of the turbo-molecular-pump mechanism and the temperature of the thread-groove-pump mechanism can be separately controlled.

The invention as in claim 12 provides, in the configuration according to claim 1, 2, 3, 4, 5, 6, 7, 8, 9, 10, or 11, a vacuum pump in which the second temperature regulating means controls the temperature with reference to a sublimation curve based on the relationship between a temperature and a pressure of the gas.

With this configuration, the temperature of gas to be treated is controlled with reference to the sublimation curve based on the relationship between a temperature and a pressure of the gas to be treated. Thus, the gaseous state of a reaction product in gas can be easily maintained.

The invention can minutely control a temperature without adversely affecting electric parts in the vacuum pump and the electric motor for rotating the rotor and without affecting a decrease in the strength of the rotor and the stator. This achieves a normal operation of the pump while suppressing the solidification of gas.

The Summary is provided to introduce a selection of concepts in a simplified form that are further described in the Detail Description. This summary is not intended to identify key features or essential features of the claimed subject matter, nor is it intended to be used as an aid in determining the scope of the claimed subject matter.

DETAILED DESCRIPTION

Figure 1:
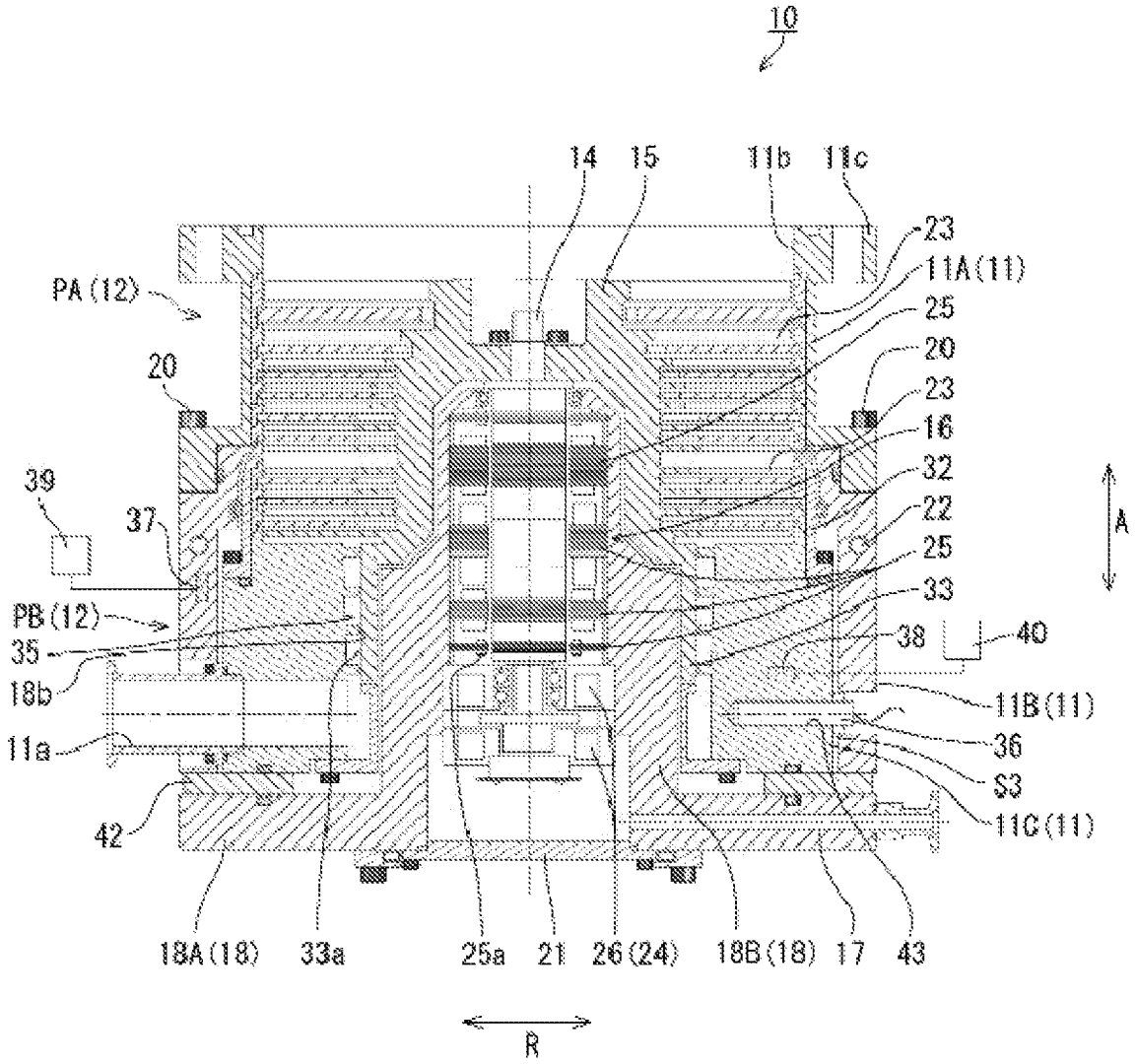
FIG. 1 is a cross-sectional view of a vacuum pump according to an embodiment of the present invention.

In order to attain an object of suppressing the solidification of gas in a normal operation of a pump, the present invention is implemented by providing a vacuum pump, including: a casing, the casing having an inlet port for sucking gas from outside and an outlet port for exhausting the gas to the outside; a turbo-molecular-pump mechanism, the turbo-molecular-pump mechanism being disposed in the casing and including rotor blades and stator blades alternately arranged in multiple stages in an axial direction; a thread-groove-pump mechanism, the thread-groove-pump mechanism being disposed in the casing and being connectedly disposed on an exhaust side of the turbo-molecular-pump mechanism; a bearing, the bearing rotatably holding a rotating portion of the turbo-molecular-pump mechanism and a rotating portion of the thread-groove-pump mechanism; and a motor portion configured to rotate the rotating portions, the vacuum pump further including: first temperature regulating means configured to regulate cooling of the turbo-molecular-pump mechanism; and second temperature regulating means configured to regulate heating of the thread-groove-pump mechanism.

An embodiment for implementing the present invention will be specifically described below in accordance with the accompanying drawings. In the description, expressions indicating vertical and horizontal directions are not definite expressions. These expressions are appropriate in the drawings of the portions of the vacuum pump according to the present invention but the interpretation should be changed according to a change of the orientation of the vacuum pump.

Embodiment

Figure 2:
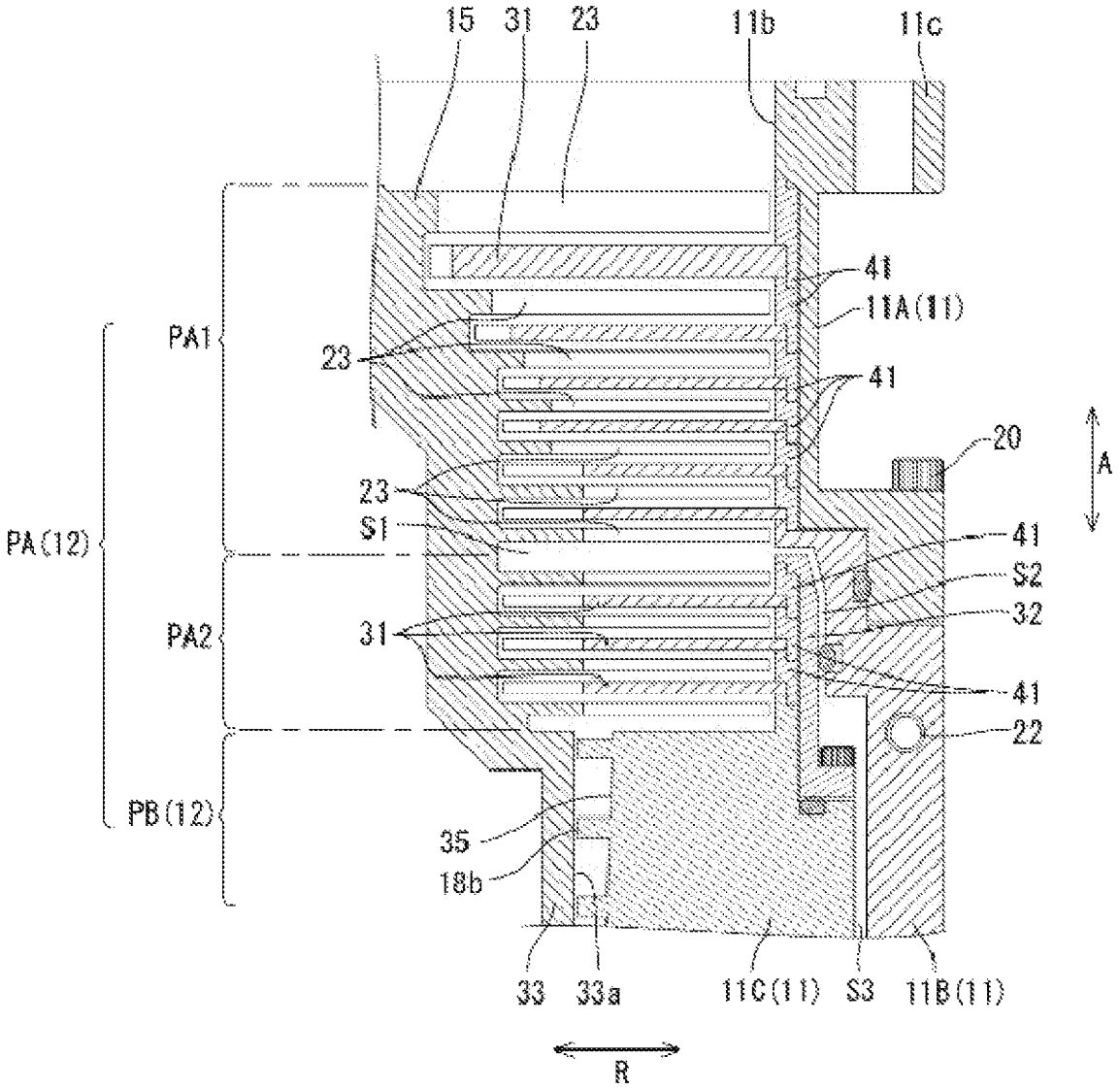
FIG. 2 is a partially enlarged cross-sectional view of the vacuum pump illustrated in FIG. 1.

FIG. 1 is a longitudinal section of a vacuum pump 10 illustrated as an embodiment of the present invention. FIG. 2 is a partially enlarged cross-sectional view of the vacuum pump 10 illustrated in FIG. 1. In FIGS. 1 and 2, the vacuum pump 10 is a combination pump of a turbo-molecular-pump mechanism PA and a thread-groove-pump mechanism PB that are provided as an exhaust function unit 12 stored in a substantially cylindrical casing 11.

The vacuum pump 10 includes the casing 11, a rotor 15 having a rotor shaft 14 rotatably supported in the casing 11, an electric motor 16 for rotating the rotor shaft 14, and a base 18 including a stator column 18B accommodating a portion of the rotor shaft 14 and the electric motor 16.

The casing 11 is shaped like a cylinder with a closed end. The casing 11 has the function of a stator for the turbo-molecular-pump mechanism PA and includes a tube portion 11A and a water-cooled spacer 11B. Moreover, a heater spacer 11C shaped like a circular pipe is disposed inside the lower portion of the water-cooled spacer 11B. The water-cooled spacer 11B is fixed to the tube portion 11A with bolts 20 and forms a vacuum-pump housing with the casing 11. Furthermore, an outlet port 11*a* is disposed on the side of the lower portion of the water-cooled spacer 11B and an inlet port 11*b* is disposed at the center of the top of the casing 11.

In the casing 11, the water-cooled spacer 11B is fixed onto a base body 18A of the base 18 with a heat insulator 42 interposed between the water-cooled spacer 11B and the base body 18A, and the heater spacer 11C is similarly fixed onto the base body 18A of the base 18 with the heat insulator 42 interposed between the heater spacer 11C and the base body 18A. This insulates the water-cooled spacer 11B and the heater spacer 11C from the base 18 via the heat insulator 42. Moreover, a clearance S3 for heat insulation is provided between the water-cooled spacer 11B and the heater spacer 11C. The water-cooled spacer 11B and the heater spacer 11C are insulated from each other by the clearance S3. Alternatively, the water-cooled spacer 11B and the heater spacer 11C may be insulated from each other by providing a heat insulator between the water-cooled spacer 11B and the heater spacer 11C.

In the water-cooled spacer 11B, a water-cooled tube 22 and a first temperature sensor 37 are embedded. Cooling water passes through the water-cooled tube 22, thereby adjusting the temperature of the water-cooled spacer 11B. A temperature change of the water-cooled spacer 11B is detected by the first temperature sensor 37 serving as a water-cooled valve temperature sensor.

The first temperature sensor 37 is connected to first temperature regulating means 39. The first temperature regulating means 39 is connected to a control unit, which is not illustrated. The first temperature regulating means 39 opens and closes a valve (not illustrated) for cooling water passing through the water-cooled tube 22 and regulates the flow rate of cooling water so as to control the temperature of the water-cooled spacer 11B to a predetermined temperature (e.g., 50° C. to 100° C.).

The base 18 includes the base body 18A to which the heater spacer 11C and the water-cooled spacer 11B are attached with the heat insulator 42 interposed between the base body 18A and the spacers, and the stator column 18B that protrudes upward from the center of the base body 18A and serves as the stator of the electric motor 16. Embedded in the base body 18A is a water-cooled tube 17. The water-cooled tube 17 has a structure in which cooling water always cools the base body 18A, a magnetic bearing 24, which will be described later, a touchdown bearing 27, and the electric motor 16. In the present embodiment, a temperature is not controlled by the water-cooled tube 17 in which cooling water always flows to keep a temperature of 25° C. to 70° C.

The tube portion 11A is attached to a vacuum vessel, e.g., a chamber, which is not illustrated, via a flange 11*c*. The inlet port 11*b* is connected so as to communicate with the vacuum vessel. The outlet port 11*a* is connected so as to communicate with an auxiliary pump, which is not illustrated.

The rotor 15 includes the rotor shaft 14 and rotor blades 23 that are fixed to the upper portion of the rotor shaft 14 and are concentrically placed around the axis of the rotor shaft 14.

The rotor shaft 14 is supported by the magnetic bearing 24 in a noncontact manner. The magnetic bearing 24 includes a radial electromagnet 25 and an axial electromagnet 26. The radial electromagnet 25 and the axial electromagnet 26 are connected to the control unit, which is not illustrated.

The control unit controls the magnetizing currents of the radial electromagnet 25 and the axial electromagnet 26 based on the detected values of a radial displacement sensor 25*a* and an axial displacement sensor 26*a*, so that the rotor shaft 14 is supported while being floated at a predetermined position.

The upper and lower portions of the rotor shaft 14 are inserted into the touchdown bearing 27. If the rotor shaft 14 is placed out of control, the rotor shaft 14 rotating at a high speed comes into contact with the touchdown bearing 27 and prevents damage to the vacuum pump 10.

A bolt 29 is inserted and screwed into a rotor flange 30 while the upper portion of the rotor shaft 14 is inserted into a boss hole 28, so that the rotor blades 23 are integrally attached to the rotor shaft 14. Hereinafter, the axial direction of the rotor shaft 14 will be referred to as "rotor axial direction A" and the radial direction of the rotor shaft 14 will be referred to as "rotor radial direction R."

The electric motor 16 includes a rotor 16A attached to outer periphery of the rotor shaft 14 and a stator 16B surrounding the rotor 16A. The stator 16B is connected to the control unit, which is not illustrated. The control unit controls the rotation of the rotor shaft 14.

The turbo-molecular-pump mechanism PA acting as the exhaust function unit 12 disposed substantially in the upper half of the vacuum pump 10 will be described below.

The turbo-molecular-pump mechanism PA includes an upper-stage-group gas transfer unit PA1 that is disposed near the inlet port 11*b* and a lower-stage-group gas transfer unit PA2 that is disposed next to the thread-groove-pump mechanism PB and is connected to the thread-groove-pump mechanism PB. The upper-stage-group gas transfer unit PA1 and the lower-stage-group gas transfer unit PA2 include the rotor blades 23 of the rotor 15 and stator blades 31, respectively. The stator blades 31 are disposed at predetermined intervals between the rotor blades 23. The rotor blades 23 and the stator blades 31 are alternately placed in multiple stages along the rotor axial direction A. In the upper-stage-group gas transfer unit PA1 of the present embodiment, the rotor blades 23 are placed in seven stages and the stator blades 31 are placed in six stages. In the lower-stage-group gas transfer unit PA2, the rotor blades 23 are placed in four stages and the stator blades 31 are placed in three stages. Moreover, a predetermined clearance S1 for heat insulation is provided between the rotor blade 23 of the final stage of the upper-stage-group gas transfer unit PA1 and the rotor blade 23 of the first stage of the lower-stage-group gas transfer unit PA2.

The rotor blade 23 includes a blade tilted at a predetermined angle and is integrated with the outer surface of the upper portion of the rotor 15. The rotor blades 23 are radially attached around the axis of the rotor 15.

The stator blade 31 includes a blade tilted opposite to the rotor blade 23. The stator blades 31 are placed in multiple stages on the inner wall surface of the tube portion 11A. The stator blades 31 are held at fixed intervals in the rotor axial direction A by spacers 41. The stator blades 31 of the upper-stage-group gas transfer unit PA1 are fixed to the water-cooled spacer 11B, whereas the stator blades 31 of the lower-stage-group gas transfer unit PA2 are fixed to the upper end of the heater spacer 11C along with an annular heat insulating spacer 32.

The heat insulating spacer 32 is heat insulating means for heat insulation between the heater spacer 11C and the water-cooled spacer 11B. The heat insulating spacer 32 is made of a material having low heat conductivity, that is, a material hardly conducting heat, for example, an aluminum material or a stainless material (a stainless material in the present embodiment). The heat insulating spacer 32 is in close contact with the lower-stage-group gas transfer unit PA2 and is separated from the inner surface of the water-cooled spacer 11B connected to the upper-stage-group gas transfer unit PA1. The separation from the inner surface of the heat insulating spacer 32 forms a clearance S2 for heat insulation between the water-cooled spacer 11B and the heat insulating spacer 32 so as to communicate with the clearance S1 for heat insulation between the rotor blade 23 of the final stage of the upper-stage-group gas transfer unit PA1 and the rotor blade 23 of the first stage of the lower-stage-group gas transfer unit PA2. In other words, the heat insulating spacer 32 and the clearances S1 and S2 for heat insulation are provided between the upper-stage-group gas transfer unit PA1 and the lower-stage-group gas transfer unit PA2, so that the upper-stage-group gas transfer unit PA1 and the lower-stage-group gas transfer unit PA2 are independent of each other and the temperatures of the transfer units PA1 And PA2 do not affect each other.

The clearances between the rotor blades 23 and the stator blades 31 gradually become narrow from above toward a lower position in the rotor axial direction A. Moreover, the rotor blades 23 and the stator blades 31 gradually become shorter from above toward a lower position in the rotor axial direction A.

The turbo-molecular-pump mechanism PA is configured such that gas sucked from the inlet port 11*b* is transferred downward (to the thread-groove-pump mechanism PB) in the rotor axial direction A by the rotations of the rotor blades 23.

The thread-groove-pump mechanism PB disposed substantially in the lower half of the vacuum pump 10 will be described below.

The thread-groove-pump mechanism PB includes a rotor cylindrical portion 33 that is disposed in the lower portion of the rotor 15 and extends along the rotor axial direction A, and the substantially cylindrical heater spacer 11C that surrounds an outer surface 33*a* of the rotor cylindrical portion 33 and serves as the stator of the thread-groove-pump mechanism PB.

Carved on an inner surface 18*b* of the heater spacer 11C is a thread groove portion 35. The heater spacer 11C is provided with a cartridge heater 36 acting as heating means and a second temperature sensor 38 acting as a heater temperature sensor for detecting a temperature in the heater spacer 11C.

The cartridge heater 36 is stored in a heater storage portion 43 of the heater spacer 11C and generates heats when being energized. The temperature of the heater spacer 11C is regulated by the generated heat. A temperature change of the heater spacer 11C is detected by the second temperature sensor 38.

The cartridge heater 36 and the second temperature sensor 38 are connected to second temperature regulating means 40. The cartridge heater 36 is connected to the second temperature regulating means 40. The second temperature regulating means 40 is connected to the control unit, which is not illustrated, controls power supply to the cartridge heater 36, and keeps a heater space at a predetermined temperature (e.g., 100° C. to 150° C.).

The operations of the vacuum pump 10 configured thus will be described below. In the vacuum pump 10, as described above, the flange 11*c* of the casing 11 having the inlet port 11*b* is attached to a vacuum vessel, e.g., a chamber that is not illustrated. In this state, when the electric motor 16 of the vacuum pump 10 is driven, the rotor blades 23 are rotated at high speed with the rotor 15. Thus, gas from the inlet port 11*b* flows into the vacuum pump 10. The gas is sequentially transferred into the upper-stage-group gas transfer unit PA1 and the lower-stage-group gas transfer unit PA2 in the turbo-molecular-pump mechanism PA and the thread groove portion 35 of the thread-groove-pump mechanism PB and then is exhausted from the outlet port 11*a* of the casing 11. In other words, the vacuum vessel is evacuated.

In the vacuum pump 10, gas is sucked from the inlet port 11*b* of the vacuum pump 10, is transferred into the casing 11, and is exhausted from the outlet port 11*a*. The gas being transferred from the inlet port 11*b* to the outlet port 11*a* is gradually compressed and pressurized.

Figure 3:
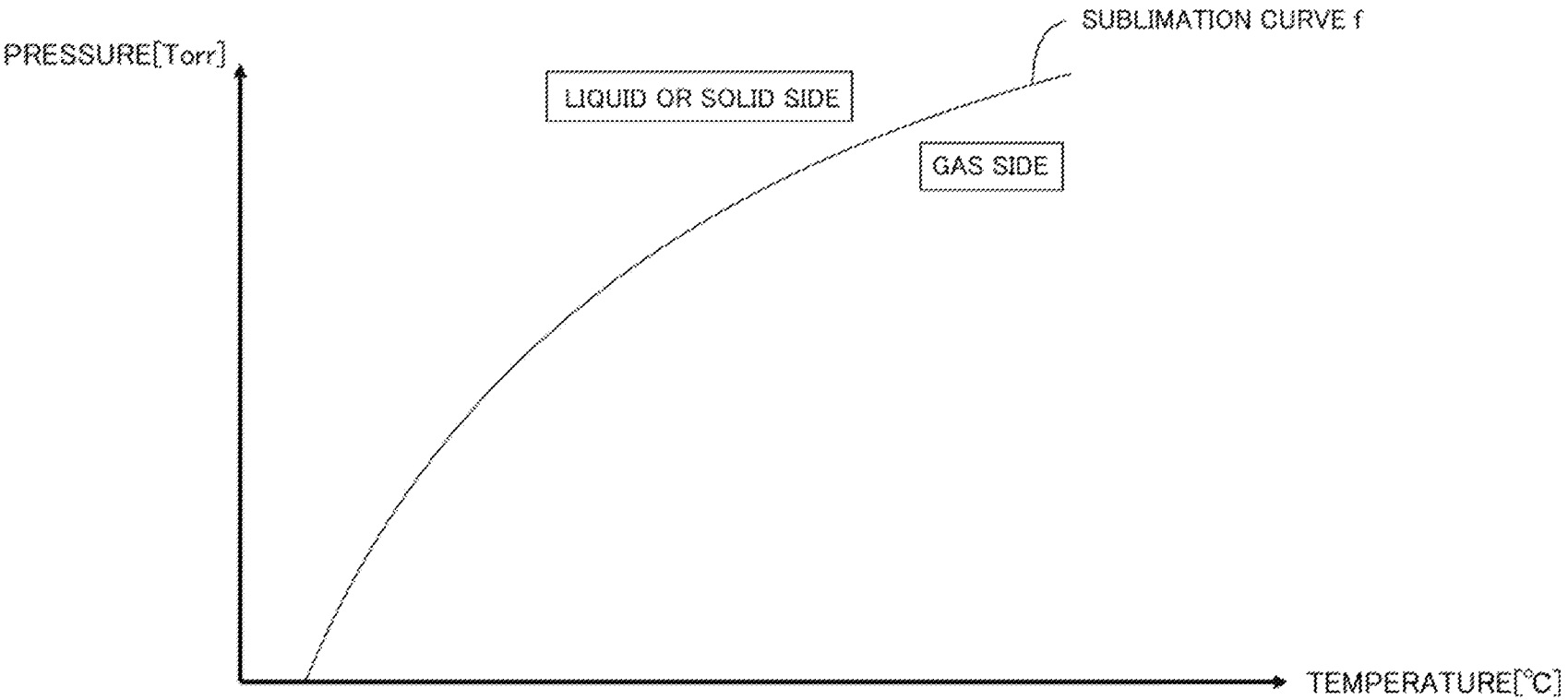
FIG. 3 is a sublimation temperature characteristic diagram indicating the relationship between a temperature and a pressure of a reaction product.

FIG. 3 indicates a sublimation curve f of typical characteristics of the relationship between a temperature and a pressure of a reaction product in gas. Specifically, in FIG. 2, the horizontal axis indicates a temperature (° C.) and the vertical axis indicates a pressure (Torr). A gaseous state is indicated below the sublimation curve f and a liquid or solid state is indicated above the sublimation curve f. The sublimation curve f changes depending upon the kind of gas.

As is evident from FIG. 3, gas molecules at a constant temperature are likely to be liquefied or solidified as a pressure rises. In other words, gas molecules are likely to be deposited in the vacuum pump 10. Specifically, when gas is sucked into the vacuum pump 10, gas molecules near the inlet port 11*b* (the upper-stage-group gas transfer unit PA1) have a low pressure and thus are likely to be placed in a gaseous state at a relatively low temperature, whereas gas molecules near the outlet port 11*a* (the lower-stage-group gas transfer unit PA2, the thread-groove-pump mechanism PB) have a high pressure and thus are unlikely to be placed in a gaseous state unless the gas reaches a high temperature.

In consideration of the relationship between the temperature and strength of the rotor blades 23 and the stator blades 31, typically in the turbo-molecular-pump mechanism PA, the rotor blades 23 and the stator blades 31 may decrease in strength and rupture at an extremely high temperature during an operation. Furthermore, in consideration of the relationship between a temperature and electric parts and the electric motor in the vacuum pump 10, the electric parts and the electric motor may typically suffer performance degradation at an extremely high temperature.

Hence, in the vacuum pump of the present embodiment, the heat insulating spacer 32 serving as heat insulating means is provided between the rotor blade 23 of the final stage of the upper-stage-group gas transfer unit PA1 and the rotor blade 23 of the first stage of the lower-stage-group gas transfer unit PA2. Thus, the upper-stage-group gas transfer unit PA1 as a medium temperature portion regulated at 50° C. to 100° C. and the lower-stage-group gas transfer unit PA2 as a high temperature portion regulated at 100° C. to 150° C. are independent of each other, so that the temperatures of the transfer units PA1 And PA2 do not affect each other. Furthermore, in the temperature control of the upper-stage-group gas transfer unit PA1 and the temperature control of the lower-stage-group gas transfer unit PA2, the upper-stage-group gas transfer unit PA1 as a medium temperature portion is controlled by the first temperature regulating means 39, and the lower-stage-group gas transfer unit PA2 as a high temperature portion and the thread-groove-pump mechanism PB are controlled by the second temperature regulating means 40. The control by the first temperature regulating means 39 and the second temperature regulating means 40 is adjusted such that the temperature of each portion falls below the sublimation curve f of FIG. 3. The sublimation curve f is used as, for example, a map. A temperature is not particularly regulated in the base body 18A serving as a low temperature portion for cooling the magnetic bearing 24, the touchdown bearing 27, and the electric motor 16. The base body 18A is always kept at 25° C. to 70° C. by passing cooling water through the water-cooled tube 17. The temperatures of the medium temperature part, the high temperature part, and cooling water passing through the water-cooled tube 17 are not limited to the above-mentioned values.

As described above, in the vacuum pump 10 of the present embodiment, the cooling of the turbo-molecular-pump mechanism PA is regulated by the first temperature regulating means 39 and the heating of the thread-groove-pump mechanism PB is regulated by the second temperature regulating means 40, so that the temperature of the turbo-molecular-pump mechanism PA and the temperature of the thread-groove-pump mechanism PB are separately controlled. Thus, the temperature of gas passing through the gas transfer units PA1 and PA2 can be minutely controlled in each portion of the casing 11. In other words, the temperature can be minutely controlled without adversely affecting the electric parts in the vacuum pump 10 and the electric motor 16 for rotating the rotor and without affecting a decrease in the strength of the rotor 15 and the stator. This achieves a normal operation of the pump while efficiently suppressing the solidification of gas.

Figure 4:
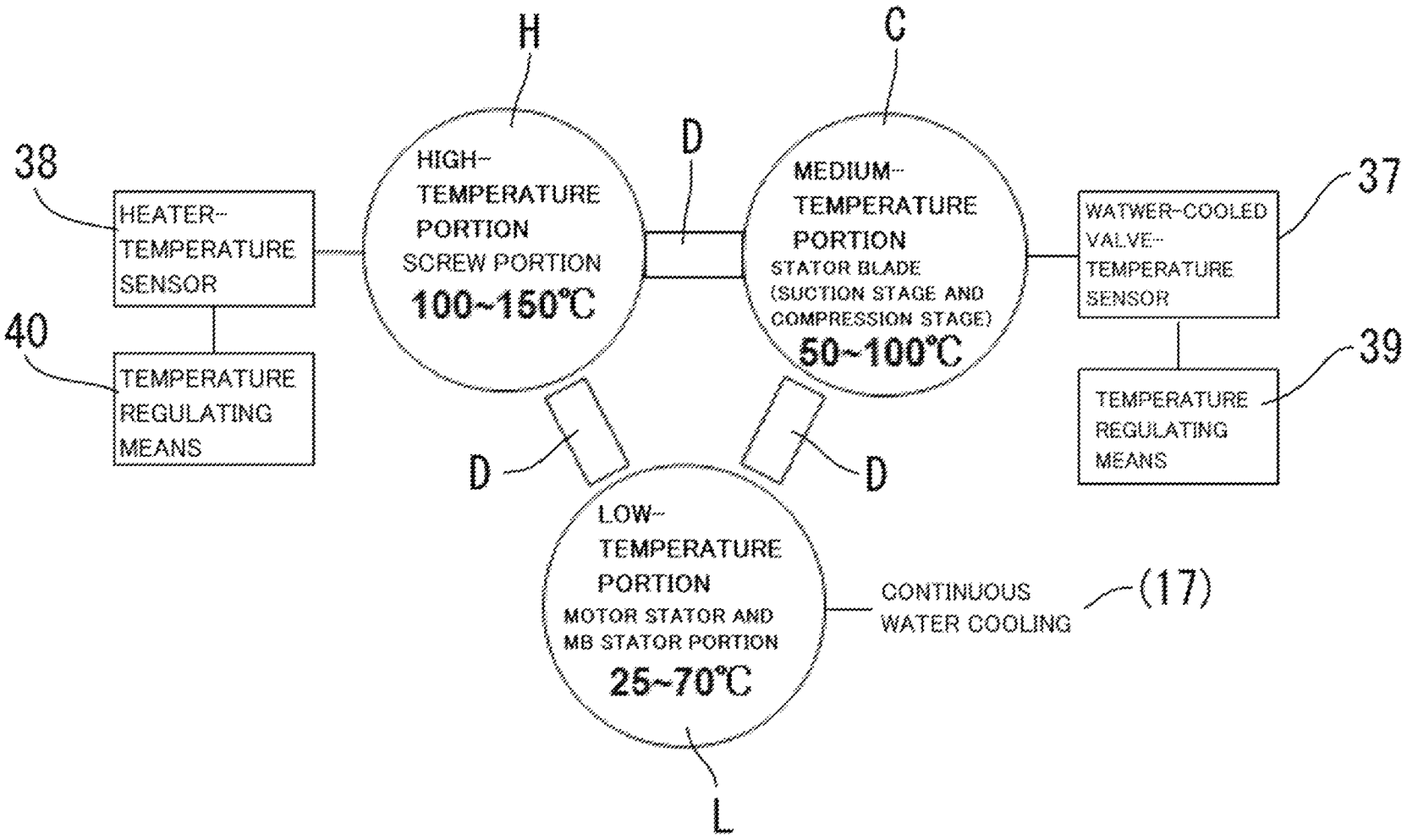
FIG. 4 is a configuration block diagram of the vacuum pump illustrated in FIG. 1.

As schematically illustrated in FIG. 4, heat insulating means D (the heat insulating spacer 32, the heat insulator 42, and the clearances S1, S2, S3) is provided between the water-cooled spacer (stator) 11B of the turbo-molecular-pump mechanism PA of a medium temperature portion C and the heater spacer (stator) 11C of the thread-groove-pump mechanism PB of a high temperature portion H and between the heater spacer (stator) 11C of the thread-groove-pump mechanism PB of the high temperature portion H and the stator column (stator) 18B of the electric motor 16 of a low temperature portion L. Thus, the temperature of the turbo-molecular-pump mechanism PA and the temperature of the thread-groove-pump mechanism PB can be separately controlled without adversely affecting each other.

The magnetic bearing 24, the touchdown bearing 27, and the stator of a motor portion (stator column) have such a structure that the water-cooled tube 17 is embedded in the base body 18A and cooling water passing through the water-cooled tube 17 always cools the base body 18A, the magnetic bearing 24, the touchdown bearing 2727, and the electric motor 16. Thus, the temperature of the turbo-molecular-pump mechanism PA and the temperature of the thread-groove-pump mechanism PB can be separately controlled without affecting the magnetic bearing 24, the touchdown bearing 27, and the electric motor 16.

In the temperature regulation of the stator (heater spacer) of the turbo-molecular-pump mechanism PA, the cooling structure of the turbo-molecular-pump mechanism PA is controlled and regulated by the first temperature regulating means 39 based on a temperature detected by the first temperature sensor 37 of the turbo-molecular-pump mechanism PA. In the temperature regulation of the stator of the thread-groove-pump mechanism PB, the heating structure (cartridge heater 36) of the thread-groove-pump mechanism PB is controlled by the second temperature regulating means 40 based on a temperature detected by the second temperature sensor 38 of the thread-groove-pump mechanism PB. Thus, the temperature of the turbo-molecular-pump mechanism PA and the temperature of the thread-groove-pump mechanism PB can be separately controlled.

In the embodiment, gas is solidified (or liquefied) unless the compression stage (lower-stage-group gas transfer unit PA2) of the turbo-molecular-pump mechanism PA and the thread-groove-pump mechanism PB are heated. The heat insulating spacer 32 is provided between the upper-stage-group gas transfer unit PA1 and the lower-stage-group gas transfer unit PA2. However, if the solidification (or liquefaction) of gas is prevented by heating only the thread-groove-pump mechanism PB, the turbo-molecular-pump mechanism PA may not be divided into the upper-stage-group gas transfer unit PA1 and the lower-stage-group gas transfer unit PA2.

Figure 5:
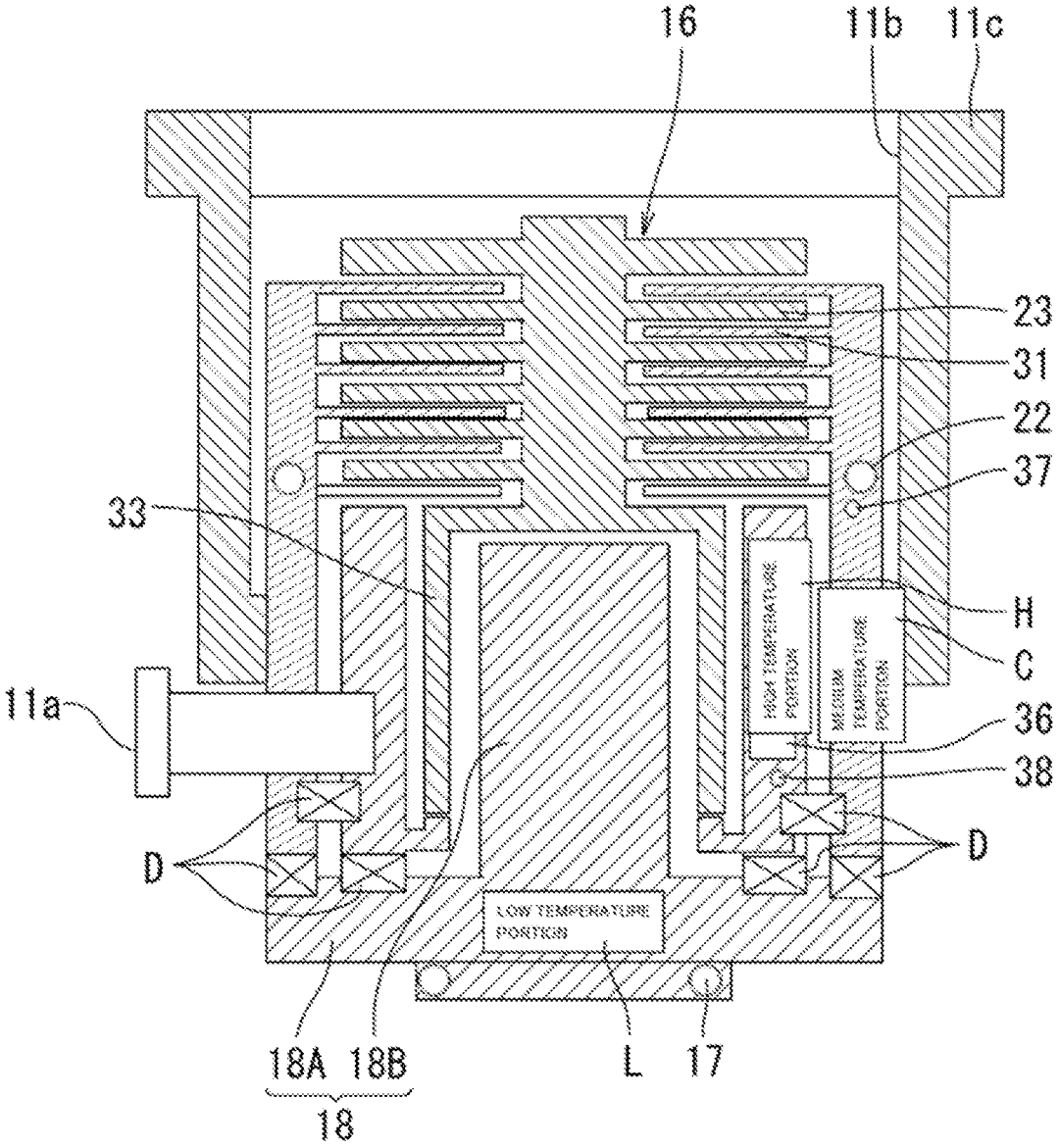
FIG. 5 is a schematic diagram of a vacuum pump according to a modification of the present invention.

FIG. 5 illustrates an example of the turbo-molecular-pump mechanism PA that is not divided into the upper-stage-group gas transfer unit PA1 and the lower-stage-group gas transfer unit PA2. In FIG. 5, the rotor blades 23 of the turbo-molecular-pump mechanism PA are connected to the water-cooled spacer 11B serving as the medium temperature portion C. Furthermore, the heat insulating means D is provided between the water-cooled spacer 11B and the heater spacer 11C serving as the high temperature portion H, between the base 18 serving as the low temperature portion L and the heater spacer 11C serving as the high temperature portion H, and between the base 18 and the water-cooled spacer 11B, preventing the medium temperature portion C, the high temperature portion H, and the low temperature portion L from thermally affecting one another. In FIG. 5, members indicated by the same reference numerals as in FIGS. 1, 2, and 4 correspond to the vacuum pump 10 illustrated in FIGS. 1, 2, and 4.

In the vacuum pump 10 of FIG. 5, the base body 18A serving as the low temperature portion L does not include temperature regulating means and is cooled all the time, and the electric motor 16 and the bearing are kept at a predetermined temperature (e.g., 25° C. to 70° C.) or lower. Cooling water passing through the water-cooled tube 22 of the water-cooled spacer 11B serving as the medium temperature portion C is regulated by the first temperature regulating means 39 based on a temperature detected by the first temperature sensor 37. A cartridge heater (heating means) 36 of a heater spacer 34 serving as the high temperature portion H is regulated by the second temperature regulating means 40 based on a temperature detected by the second temperature sensor 38. Also in this structure, the temperature control by the first temperature regulating means 39 and the second temperature regulating means 40 is adjusted such that the temperature of each portion falls below the sublimation curve f of FIG. 3. The sublimation curve f is used as a map.

The present invention can be modified in various ways without departing from the scope of the present invention. The present invention is naturally extended to the modifications.

Although elements have been shown or described as separate embodiments above, portions of each embodiment may be combined with all or part of other embodiments described above.

Although the subject matter has been described in language specific to structural features and/or methodological acts, it is to be understood that the subject matter defined in the appended claims is not necessarily limited to the specific features or acts described above. Rather, the specific features and acts described above are described as example forms of implementing the claims.

What is claimed is:

1. A vacuum pump comprising:

a casing, the casing having an inlet port for sucking gas from outside and an outlet port for exhausting the gas to the outside;

a turbo-molecular-pump mechanism, the turbo-molecular-pump mechanism being disposed in the casing and including rotor blades and stator blades alternately arranged in multiple stages in an axial direction;

a thread-groove-pump mechanism, the thread-groove-pump mechanism being disposed in the casing and being connectedly disposed on an exhaust side of the turbo-molecular-pump mechanism;

a bearing, the bearing rotatably holding a rotating portion of the turbo-molecular-pump mechanism and a rotating portion of the thread-groove-pump mechanism; and a motor portion configured to rotate the rotating portions, the vacuum pump further comprising:

first temperature regulating means configured to regulate cooling of the turbo-molecular-pump mechanism; and second temperature regulating means configured to regulate heating of the thread-groove-pump mechanism, wherein the turbo-molecular-pump mechanism is divided into an upper-stage-group gas transfer unit that is disposed downstream from the inlet port and is cooled by the first temperature regulating means, and a lower-stage-group gas transfer unit that is disposed upstream of the thread-groove-pump mechanism and is heated by the second temperature regulating means, and heat insulating means is provided between the first temperature regulating means and the lower-stage-group gas transfer unit, wherein a portion of the heat insulation means extends axially adjacent the lower-stage-group gas transfer unit.

2. The vacuum pump according to claim 1, further comprising:

a second heat insulating means, the second heat insulating means being provided between a stator of the thread-groove-pump mechanism and a stator of the motor portion.

3. The vacuum pump according to claim 1, wherein the bearing and a stator of the motor portion are always cooled.

4. The vacuum pump according to claim 1, wherein a stator of the turbo-molecular-pump mechanism includes a first temperature sensor and a cooling structure;

a stator of the thread-groove-pump mechanism includes a second temperature sensor and a heating structure;

the first temperature regulating means regulates a temperature of the cooling structure of the turbo-molecular-pump mechanism based on a temperature detected by the first temperature sensor of the turbo-molecular-pump mechanism, and the second temperature regulating means regulates a temperature of the heating structure of the thread-groove-pump mechanism based on a temperature detected by the second temperature sensor of the thread-groove-pump mechanism.

5. The vacuum pump according to claim 1, wherein a temperature of the lower-stage-group gas transfer unit is regulated by the second temperature regulating means via the thread-groove-pump mechanism.

6. The vacuum pump according to claim 1, wherein the heat insulating means is in contact with the lower-stage-group gas transfer unit and is disposed with a clearance created between the heat insulating means and the upper-stage-group gas transfer unit.

7. The vacuum pump according to claim 5, wherein the turbo-molecular-pump mechanism includes a clearance that axially separates the upper-stage-group gas transfer unit from the lower-stage-group gas transfer unit.

8. The vacuum pump according to claim 1, wherein the heat insulating means is a stainless material.

9. The vacuum pump according to claim 5, wherein the first temperature regulating means regulates a temperature of the upper-stage-group gas transfer unit based on a temperature detected by a first temperature sensor for detecting the temperature of the upper-stage-group gas transfer unit, and the second temperature regulating means regulates a temperature of the thread-groove-pump mechanism based on a temperature detected by a second temperature sensor for detecting the temperature of the thread-groove-pump mechanism.

10. The vacuum pump according to claim 1, wherein the bearing and a bearing portion of the motor portion are magnetic bearings.

11. The vacuum pump according to claim 1, wherein the second temperature regulating means controls the temperature with reference to a sublimation curve based on a relationship between a temperature and a pressure of the gas.

* * * * *